United States Patent [19]

Erickson

[11] Patent Number: 4,589,681

[45] Date of Patent: May 20, 1986

[54] SKI POLE MODIFYING APPARATUS

[76] Inventor: John S. Erickson, 11201 SE. Third - 39G, Everett, Wash. 98204

[21] Appl. No.: 549,774

[22] Filed: Nov. 8, 1983

[51] Int. Cl.[4] ..... A63C 11/22

[52] U.S. Cl. ..... 280/819; 135/66; 297/438

[58] Field of Search ..... 280/819, 812, 813, 816, 280/820, 809; 294/15, 86.42; 104/173 ST; 135/65, 66; 297/439, 438, 423

[56] References Cited

U.S. PATENT DOCUMENTS

| | | | |
|---|---|---|---|
| 4,299,409 | 11/1981 | Gedicks | 280/819 |
| 4,341,400 | 7/1982 | Morgan | 280/819 |
| 4,358,138 | 11/1982 | Laughlin | 280/819 |

*Primary Examiner*—John J. Love
*Assistant Examiner*—Joseph G. McCarthy
*Attorney, Agent, or Firm*—Arthur L. Urban

[57] ABSTRACT

Ski pole modifying apparatus including a support portion, a hanger portion, a pivoting portion and a stabilizer portion; the support portion including an elongated main section, the main section being capable of mounting on a ski pole intermediate the ends thereof; the hanger portion extending from the support portion, the hanger portion including an arm member with a free end, the arm member being capable of extending generally perpendicularly from the main section; the pivoting portion including mechanism for changing the position of the hanger portion about a transverse axis through the ski pole from a position in which the free end of the arm member of the hanger portion is remote from the ski pole to a position in which the free end is disposed adjacent to the ski pole; the stabilizer portion retaining the position of the hanger portion with respect to the ski pole; whereby when the modifying apparatus is mounted on a ski pole, the hanger portion can be pivoted to a position so it can lay on a ski lift seat to enable a skier to rest his feet on ski pole baskets.

8 Claims, 8 Drawing Figures

SKI POLE MODIFYING APPARATUS

This invention relates to a novel apparatus and more particularly relates to a new apparatus for modifying ski poles.

People have enjoyed skiing for many years. Originally, skiing was done as a means of transporation and involved so-called cross-country skiing. Cross-country skiing enabled a person to move across the snow covered area more rapidly than by walking or using snowshoes.

More recently, so-called downhill skiing has become very popular. This type of skiing involves skiing down hills or mountains and is done as a sport rather than for transportation. In the initial years of downhill skiing, persons had to expend considerable effort and ingenuity to get to the top of the slope in order to be at a starting point for the downhill runs. At that time, an individual had to walk up the hill carrying his skis. Being a skier at that time required a person to be in excellent physical condition in order to be able to climb the slopes.

Since most people did not wish to undertake such climbing, ski tows or lifts were developed as a means of getting to the top of the mountains. Also, as downhill skiing became more popular, new businesses were started which offered may types of new equipment, clothing and accessories for skiers. Such new items made skiing easier and more convenient so that the average person could enjoy the sport and become reasonably proficient.

With the development of lifts and skiing equipment, skiers were able to spend more time skiing instead of getting to the top of the mountain. The greater amount of time spent in skiing and the fact that people in average condition were skiing, resulting in skiers becoming tired during a day's outing. In order to overcome this tiredness, skiers had to rest their bodies.

Resting usually was accomplished by stopping at intervals along the slopes or by spending time in a lodge or warming hut. While these expedients did provide rest for the skier's body, most skiers tried to minimize their rest periods in order to get in a maximum amount of skiing in a given period of time.

This was because skiers generally had to travel long distances to the ski areas and could only ski a limited number of times. Also, the expenses involved in skiing are considerable both in the investment in equipment and clothing and also in lift tickets.

To reduce the cost of each skiing hour, skiers try to spread the cost over the maximum number of actual skiing hours. In order to accomplish this result, it is necessary to maximize the amount of actual skiing done on each skiing day. However, maximizing the skiing requires that rest periods be virtually eliminated.

While to a casual observer it would appear that the lift rides would be excellent rest periods, most ski lifts are not designed for this purpose. Lifts transport skiers to the top of the mountain rather than provide a high degree of skier comfort and rest.

A particular deficiency of most ski lifts is the lack of support for the skier's legs. Although a few lifts have foot rests, the great proportion of the lifts provide no foot or leg support whatsoever. The skier simply sits on the lift seat and dangles his legs.

The lack of support for the legs is a problem any time a person is sitting on a seat in which his legs do not reach the floor, but it is a much more serious problem for skiers who are wearing relatively heavy boots and skis on their feet. The extra weight of this equipment tends to tire the legs more even than when the skier's legs and feet are in contact with the ground as he skis down a slope or run.

Through the years skiers have attempted to solve the problem of leg fatigue during lift rides. Some individuals try to hook the tips of their skis into the straps on their ski pole grips. This involves reversing and manipulating the poles which may be uncomfortable. It also requires concentration and strength to hold the poles in place. Other skiers have tried lengths of cord which they tie to the lift and slip under their skis. This arrangement requires considerable dexterity and effort.

Another problem with such makeshift efforts is that all of the activity must be accomplished while the skier is sitting on a lift chair that is high above the ground. Since these expedients require that the skier direct his attention to the task at hand rather than concentrating on holding on to the lift, the risk of falling from the lift and incurring injury is greatly increased. As a result, only a very few skiers use such devices and the great proportion of skiers simply become tired and frustrated.

From the above discussion, it is clear that past and present methods and devices for providing support for skiers' legs while riding a ski lift leave much to be desired. Thus, there is a need for new products that overcome the deficiencies of previous devices.

The present invention provides a novel ski pole modifying apparatus that overcomes the shortcomings of previous leg support devices. The ski pole modifying apparatus of the present invention provides effective leg support for a skier riding a lift. The modifying apparatus can be positioned for use easily and retracted when not needed quickly and conveniently. Thus, the apparatus of the invention does not interfere with the use of the ski poles while skiing or during transport.

The ski pole modifying apparatus of the invention is simple in design and can be produced relatively inexpensively. The apparatus can be fabricated from commercially available materials and components. Conventional metal working techniques and procedures and semiskilled labor can be employed in its manufacture.

The modifying apparatus of the invention can be mounted on a ski pole easily by persons with ordinary mechanical skills and experience after a minimum of instruction. The apparatus can be mounted on a wide variety of different ski poles. The apparatus can be utilized both on ski poles presently in use as well as on new poles that are being manufactured.

The ski pole modifying apparatus is durable in construction and has a long useful life. Little, if any, maintenance is required to keep the apparatus in working condition. The apparatus can be changed from one set of poles to another if desired easily and quickly.

The ski pole modifying apparatus of the invention can be used safely by persons of all ages. Little instruction is required to enable the skier to use the apparatus efficiently and conveniently. The apparatus can be adapted easily to fit different skiers and the growth of youngsters.

These and other benefits and advantages of the novel ski pole modifying apparatus of the present invention will be apparent from the following description and the accompanying drawings in which.

Figure 1:
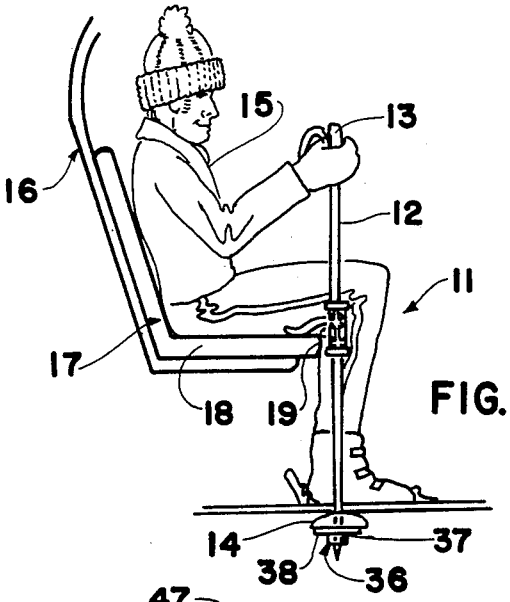
FIG. 1 is a schematic illustration of one form of the ski pole modifying apparatus of the invention in use while mounted on a ski pole.
Figure 2:
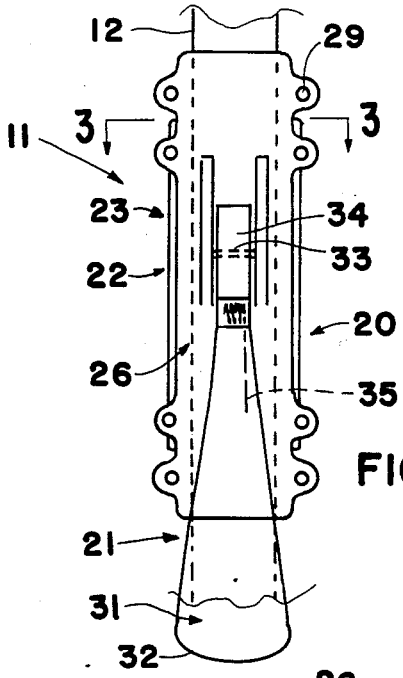
FIG. 2 is an enlarged right side view of the ski pole modifying apparatus shown in FIG. 1 with the hanger portion in a retracted position.
Figure 3:
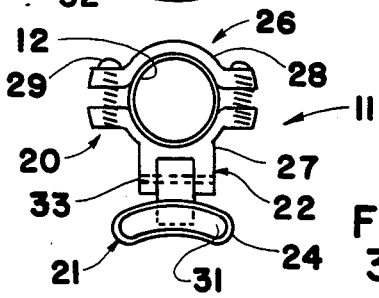
FIG. 3 is a sectional view of the apparatus shown in FIG. 2 taken along line 3—3 thereof.

As shown in FIGS. 1-3 of the drawings, one form 11 of the ski pole modifying apparatus of the present invention is mounted on a ski pole 12. The ski pole 12 which includes a grip 13 and a basket 14 is being used by a skier 15 riding a lift 16. The lift 16 includes a chair 17 with a seat 18 on which the skier is seated.

The ski pole modifying apparatus 11 includes a support portion 20, a hanger portion 21, a pivoting portion 22 and a stabilizer portion 23. Advantageously, at least a portion of the outer surface of the apparatus includes a resilient covering 24. The resilient covering 24 preferably includes a rubber or plastic coating and most preferably a plastisol coating.

The support portion 20 of the ski pole modifying apparatus 11 of the present invention includes an elongated main section 26. The main section 26 is mounted on a ski pole 12 intermediate the ends thereof, that is, gripping section 13 and baseket section 14. Advantageously, as shown, the main section 26 includes a pair of clamping sections 27 and 28. The clamping sections 27 and 28 surround the ski pole 12. The clamping sections are secured to one another through suitable fasteners such as bolts 29.

The hanger portion 21 of the modifying apparatus 11 includes an arm member 31. Arm member 31 includes a free end 32. The arm member is capable of extending generally perpendicularly from the main section. The arm member 31 preferably is pivotally connected to the main section 26.

The pivoting portion 22 of the modifying apparatus 11 includes means for changing the position of the hanger portion 21 about a transverse axis through the ski pole. The pivoting portion 22 advantageously includes a shaft 33 that is disposed transversely of the ski pole 12. The pivoting of the hanger portion is from a position in which the free end 32 of the arm member 31 of the hanger portion is remote from the ski pole as shown in FIG. 1 to a position in which the free end is disposed adjacent to the ski pole as shown in FIGS. 2 and 3.

The stabilizer portion 23 of the ski pole modifying apparatus 11 retains the position of hanger portion 21 with respect to the ski pole. The stabilizer portion 23 advantageously includes a section 34 affixed to the hanger portion 21. Also, the stabilizer portion preferably includes biasing means shown as coil spring 35. The spring urges the hanger portion 21 toward the ski pole into a retracted position.

In the use of the ski pole modifying apparatus 11 shown in FIGS. 1-3 of the drawings, the clamping sections 27 and 28 are placed around the ski pole 12 and loosely connected by bolts 29. The assembled sections 27 and 28 are then slid along the length of the pole until they are disposed at a distance from the ski tip that is equivalent to the distance between the midpoint of the skier's knee and the floor. The bolts then are tightened to secure the assembly in place.

The tightness of the ski basket 14 on the poles is checked. If the basket is not tightly affixed to the pole, it may be necessary to secure the basket thereto through a suitable fastener or more preferably through the use of a clamp 36 positioned below the basket. The clamp 36 may include fastening means shown as screw 37 and radial extensions 38 to increase the rigidity of the basket.

The ski poles 12 and the modifying apparatus 11 now are ready for use. At this point, the hanger portion 21 is disposed adjacent to the ski pole with the free end 32 of the arm member 31 in contact with the pole as shown in FIGS. 2 and 3.

When a skier desires to rest his legs while riding on lift 16, he simply draws the free ends 32 of arm members 31 away from the ski poles against the resistance of springs 35 causing the arm members to pivot on shafts 33. The hanger portions 21 then are placed on the top of lift seat 18 as shown in FIG. 1 with the ski poles in a substantially vertical position. The skier's hands grasp the pole grips 13 and exert a slight pull thereon to maintain the ski poles against edge 19 of the seat 18. The skier places his skis on top of the baskets 14 and rests the skis thereon while he rides the lift.

When it is time to get off the lift, the skier simply lifts his skis from the baskets and pulls the ski poles away from the lift seat. This action automatically causes the arm members 31 to pivot back against the ski poles due to the biasing force of spring 35. The skier can now use his poles normally without interference from the apparatus. When the skier returns to the lift again, he simply repeats the above steps to rest his legs. If it is necessary to adjust the position of the apparatus, the skier loosens bolts 29 and moves the support portion up or down as desired.

Figure 4:
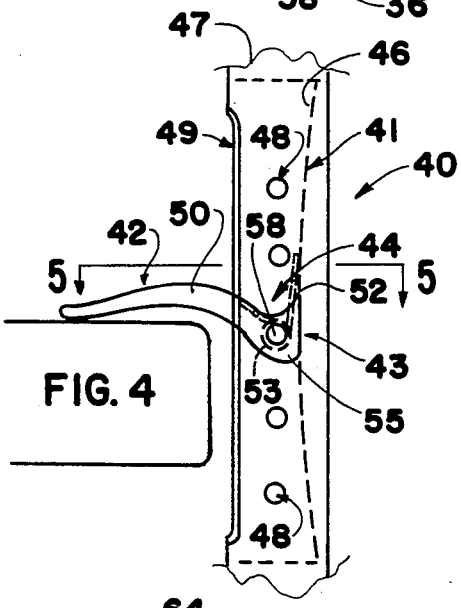
FIG. 4 is a side view of another form of the ski pole modifying apparatus of the invention in use.
Figure 5:
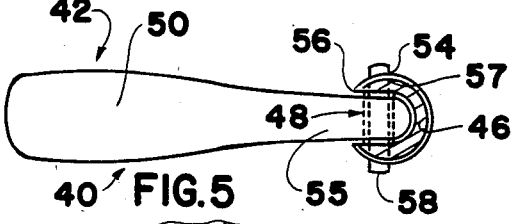
FIG. 5 is a sectional view of the apparatus shown in FIG. 4 taken along line 5—5 thereof.

FIGS. 4 and 5 illustrate another form 40 of the ski pole modifying apparatus of the present invention. As shown, the apparatus 40 includes a support portion 41, a hanger portion 42, a pivoting portion 43 and a stabilizer portion 44. The hanger, pivoting and stabilizer portions 42-44 of the apparatus 40 are similar to the corresponding portions 21-23 of the apparatus 11 described above.

The support portion 41 of the modifying apparatus 40 includes an elongated main section 46 which is mounted along the length of the ski pole 12. However, the main section is a unitary component that is mounted within a hollow central chamber 47 of the ski pole 12. The main section 46 is tapered to allow it to be slid along the ski pole chamber from the grip end.

The main section 46 advantageously includes a plurality of longitudinally spaced shaft supports or openings 48. These spaced shaft supports provide a convenient means for adjusting the position of the hanger portion along the length of the ski pole.

Access to the shaft supports 48 is achieved by forming an elongated opening 49 in the sidewall of the ski pole adjacent to the position of the main section 46 as shown in FIG. 4. This opening preferably is formed prior to insertion of the main section. The apparatus 40 also includes an arm member 50 advantageously disposed on a shaft 58. The apparatus 40 also includes a stabilizer section 52 affixed to the hanger portion and a coil spring 53.

If desired, the main section 46 of the modifying apparatus 40 can be integrally formed with the ski pole during the fabrication thereof. For example, the pole sidewall can be formed with a side opening that includes an internal channel which functions as a support portion for the hanger portion 42.

The apparatus 40 is installed by forming an elongated opening 49 in the sidewall of ski pole 12 at approximately the distance between the skier's knee and the ski tip when placed on the ground. Next, grip 13 is removed from the pole and main section 46 inserted into the pole chamber 47 until the section is positioned at the opening 49 and wedged inside the pole.

Openings 54 are drilled through the pole at points aligned with the shaft supports 48 of the main section. Inner end 55 of hanger portion 42 is inserted into a channel 56 in the main section 46 and an opening 57 thereof aligned with one of the shaft supports 48 and openings 54. A shaft 58 is inserted therethrough to secure the hanger portion.

The apparatus 40 and the pole 12 are used in the same manner as the apparatus 11 descirbed above. To adjust the position of the hanger portion 42, shaft 58 is removed and the hanger portion 42 moved to a higher or lower position. The shaft then is reinserted.

Figure 6:
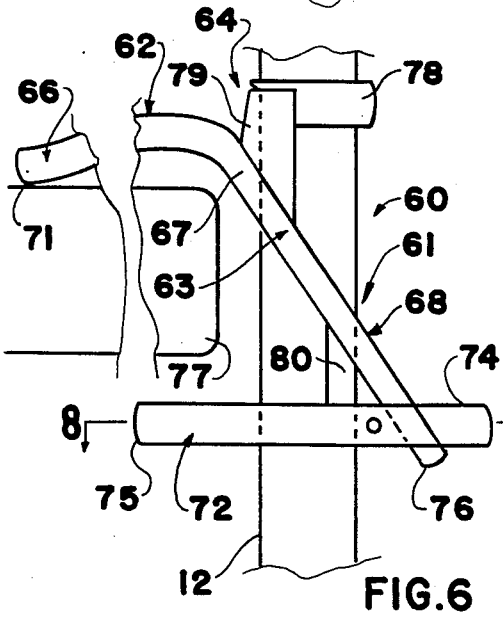
FIG. 6 is a side view of a further form of the ski pole modifying apparatus of the invention in use.
Figure 7:
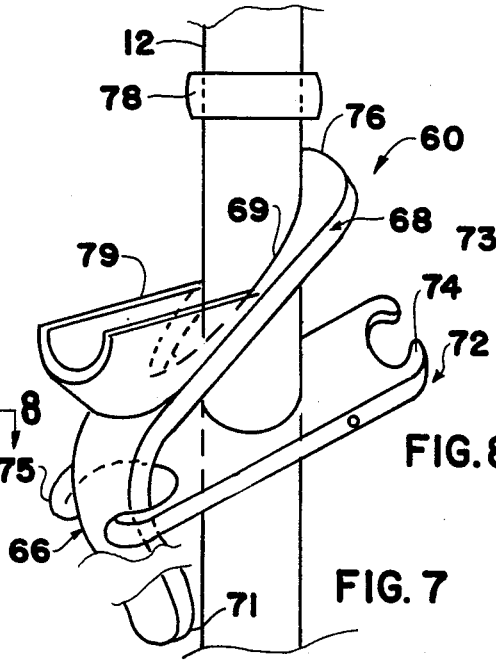
FIG. 7 is a side view of the apparatus shown in FIG. 6 in a retracted position.
Figure 8:
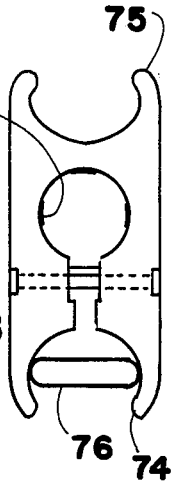
FIG. 8 is a sectional view of the apparatus shown in FIG. 6 taken along line 8—8 thereof.

As shown in FIG. 6–8, another form 60 of the ski pole modifying apparatus includes a support portion 61, a hanger portion 62, a pivoting portion 63 and a stabilizer portion 64. In apparatus 60, the hanger portion 62 including an arm member 66 is rigidly affixed to one end 67 of a support portion main section 68.

The pivoting portion 63, instead of including a shaft as present in the apparatus 11 and 40, rather includes an elongated opening 69 along the length of the main section. This elongated opening 69 permits the apparatus to be pivoted from a position in which a free end 71 of arm member 66 of the hanger portion is remote from the ski pole 12 as shown in FIG. 6 to a positon in which the free end of the arm member is adjacent to the ski pole (FIG. 7).

The stabilizer portion 64 includes a clip member 72 as shown in FIG. 8 that is positioned on the ski pole below the support portion 61, that is, on the side thereof toward the ski basket. The clip member 72 includes a central opening 73 that engages the ski pole and open ended side holding sections 74 and 75. Section 74 engages an end 76 of main section 68 when the hanger portion is remote from the ski pole for engagement with lift chair 77 as shown in FIG. 6. Similarly, section 75 engages hanger free end 71 (FIG. 7) when the hanger portion is pivoted into a retracted position.

The apparatus 60 also preferably includes a stop member 78 disposed above the support portion 61, that is, toward the ski pole grip. Advantageously, the stop member 78 is formed of a resilient material to provide a bearing surface for an arcuate section 79 extending from the hanger portion. Another arcuate section 80 preferably is disposed adjacent the lower end 76 of the main section to provide alignment with the ski pole. The combination of the clip member 72 and the stop member 78 facilitates retention of the support portion 61 in a particular area along the length of the ski pole.

In the use of the ski pole modifying apparatus 60 shown in FIGS. 6–8, the apparatus first is mounted on a ski pole 12. This is accomplished by first removing the basket 14. Next, the stop member 78 is slid along the pole to a location equivalent to the midpoint of the knee cap of the skier when the ski pole tip is resting on the floor.

Thereafter, the ski pole tip is inserted through the opening 69 of the main section 68 of the support portion 61 and the main section slid along the pole toward the stop member 78. The main section is oriented so the arcuate sections 79 and 80 are adjacent the ski pole.

The clip member 72 is inserted over the ski pole tip with the central opening 73 engaging the pole. The clip member 72 is moved along the pole until it reaches a position where holding section 74 thereof is aligned with end 76 of the main section while arcuate section 79 is in contact with stop member 78. The basket 14 is replaced on the ski tip.

The main section 68 is pivoted about the opening 69 to move the free end 71 of the hanger portion into engagement with the holding section 75 of the clip member 72. The ski pole and the apparatus now are ready for use.

When the skier desires to rest his legs while riding a lift, he simply lifts the hanger arm member 66 away from the ski pole, causing the main section to pivot about the elongated opening 69 until the lower end 76 locks into the holding section 74. The apparatus now is used as the apparatus 11 and 40 described above.

The hanger arm 66 is placed on top of the chair seat 18 with the poles against the free edge 19 of the seat. The skier grasps the pole grips and draws them against the seat edge with slight pressure. The skier places his skies on the top of the baskets 14 for the duration of the lift ride.

Upon approaching the top of the lift, the skier lifts his skis from the baskets and release his poles from the seat. The free end 71 of the hanger portion is pivoted against the ski pole and into engagement with the holding section 75 of the clip member. The skier now used his poles as he normally would while skiing down the slope. When the skier wishes to rest his legs again while riding the lift, he repeats the above steps and reverses the position of the hanger portion for the ride.

The ski pole modifying apparatus of the present invention can be fabricated from any of a wide variety of different materials including metals, wood, plastics, combinations thereof and the like. Advantageously, the apparatus is fabricated from combinations of metals and plastics.

The above description and the accompanying drawings show that the present invention provides a noval ski pole modifying apparatus with advantages and benefits not found in previous devices. The ski pole modifying apparatus provides effective leg support for a skier riding a lift which heretofore was not attainable. The modifying apparatus also provides a simplified means for activating the apparatus which can be operated quickly and conveniently. The apparatus is easily retracted when not in use and does not interfere with normal skiing activity.

The ski pole modifying apparatus of the present invention is simple in design and can be manufactured relatively inexpensively. Commercially available materials and components and conventional metal working techniques can be employed in its fabrication. The apparatus is durable in construction and has a long useful life with a minimum of maintenance.

The modifying apparatus can be installed on ski poles easily by persons with limited mechanical experience after a minimum of instruction. The apparatus can be adapted to fit different types of ski poles. The apparatus can be adjusted easily for persons of all ages and body configurations. The apparatus can be changed from one ski pole to another quickly. The apparatus can provide automatic retraction thereof to provide safe operation of the poles.

It will be apparent that various modifications can be made in the particular apparatus described in detail and shown in the drawings within the scope of the invention. The size, configuration and arrangment of components can be changed to meet specific requirements. Also, different biasing means and fasteners can be employed. These and other changes can be made in the ski pole modifying apparatus aprovided the functioning and operation thereof are not adversely affected. Therefore, the scope of the present invention is to be limited only by the following claims.

What is claimed is:

1. Ski pole modifying apparatus including a support portion, a hanger portion, a pivoting portion and a stabilizer portion; said support portion including an elongated main section, said main section being capable of disposition within a hollow ski pole intermediate the ends thereof, said support portion including a plurality of longitudinally spaced shaft supports; said hanger portion extending from said support portion, said hanger portion including an arm member with a free end, said arm member having a width several times the thickness thereof, said arm member being capable of extending generally perpendicularly from said main section; said pivoting portion including shaft means for changing the position of said hanger portion about a transverse axis through said ski pole from a position in which said free end of said arm member of said hanger portion is remote from said ski pole to a position in which said free end is disposed adjacent to said ski pole; said stabilizer portion retaining the position of said hanger portion with respect to said ski pole; whereby when said modifying apparatus is mounted on a ski pole, said hanger portion can be pivoted to a position so it can lay on a ski lift seat to enable a skier to rest his feet on ski pole baskets.

2. Ski pole modifying apparatus according to claim 1 wherein said main section is disposed longitudinally of said ski pole.

3. Ski pole modifying apparatus according to claim 1 wherein said main section is secured to a sidewall of said ski pole.

4. Ski pole modifying apparatus according to claim 1 wherein said hanger portion is pivotally connected to said main section.

5. Ski pole modifying apparatus according to claim 1 wherein said stabilizer portion includes a section affixed to said hanger portion.

6. Ski pole modifying apparatus according to claim 1 wherein said stabilizer portion includes biasing means urging said hanger portion toward said ski pole.

7. Ski pole modifying apparatus according to claim 1 including a resilient covering over at least a portion of the outer surface of said apparatus.

8. Ski pole modifying apparatus according to claim 7 wherein said resilient covering includes a plastisol coating.

* * * * *